United States Patent [19]

Stoll et al.

[11] Patent Number: 5,048,569

[45] Date of Patent: Sep. 17, 1991

[54] VALVE COMPONENT GROUP

[75] Inventors: Kurt Stoll; Manfred Rüdle, both of Esslingen, Fed. Rep. of Germany

[73] Assignee: Festo KG, Esslingen, Fed. Rep. of Germany

[21] Appl. No.: 581,282

[22] Filed: Sep. 12, 1990

[30] Foreign Application Priority Data

Feb. 16, 1990 [DE] Fed. Rep. of Germany ..... 4004834

[51] Int. Cl.[5] ..... F15B 13/043

[52] U.S. Cl. ..... 137/625.64; 137/884

[58] Field of Search ..... 137/596.16, 625.64, 137/884

[56] References Cited

U.S. PATENT DOCUMENTS 3,513,876 5/1970 Tarbox ..... 137/884 X
4,726,393 2/1988 Herner ..... 137/884 X
4,889,164 12/1989 Hozumi et al. ..... 137/884 X

FOREIGN PATENT DOCUMENTS 2582061 11/1986 France .
2617565 1/1989 France .

*Primary Examiner*—Gerald A. Michalsky
*Attorney, Agent, or Firm*—Flynn, Thiel, Boutell & Tanis

[57] ABSTRACT

A valve component group comprising a terminal plate containing fluid terminal ducts and a main valve arranged thereon. Between these two elements there is an intermediate plate which carries pilot valves for the main valve. For the supply of power to the pilot valves there are electrical leads with a connector thereon to provide a detachable electrical connection between the terminal plate and the intermediate plate. The main valve does not have to be supplied with any electrical power.

13 Claims, 2 Drawing Sheets

VALVE COMPONENT GROUP

FIELD OF THE INVENTION

The invention relates to a valve component group comprising a terminal plate containing fluid terminal ducts and adapted for connection with a main valve having ducts in communication with terminal ducts of the group, and at least one pilot valve, associated with said main valve and adapted to be operated via at least one electrical lead for taking effect on flow through a control duct of the main valve.

BACKGROUND OF THE INVENTION

In such a valve component group terminal or connecting ducts are formed in the terminal plate which on the one hand are able to be connected with a source of fluid under pressure, with loads or other means such as means for receiving expended fluid. On the other hand there is a connection with the ducts of a main valve, which has so far been mounted directly on the terminal plate. Using the main valve it is possible for some of the ducts to be connected with, or disconnected from each other fluidwise.

In this manner connected loads, as for instance actuator cylinders may be operated by supplying power fluid, more particularly compressed air. In order to operate the main valve there is as a rule at least one electrically operated pilot valve, more particularly in the form of a solenoid valve, operated by electrical power. So far this pilot valve has been mounted on the main valve so as to be able to influence the flow through a control duct by means of which the motion of the valve member of the main valve may be initiated.

The supply of electrical power to the pilot valve has so far been via electrical leads, which are left exposed and thus are liable to be damaged. Furthermore, when a valve is replaced the connections of the leads are liable to be confused through human error. The production of the electrical connections is also a relatively intricate operation. Therefore there has already been a proposal to supply the electrical power via the terminal plate. In this case it would then be necessary to mount the male and female parts of a plug connector on the terminal plate and the main valve and it would be necessary to provide extra space in order to make it possible to internally accommodate the wiring leading to the pilot valves. Such a design does however involve the disadvantage that the overall height of the main valve has to be substantially increased owing to the necessity of accommodating the associated parts of the plug connector. Normally the main valve comprises an elongated valve piston in it whose distance from the lower side of the valve would have to be increased. Another point is that the wiring channels lead to a further increase in the overall volume and to an increase in the manufacturing costs of the main valve, not to speak of the problem of insulation, for in order to exclude the possibility of shortcircuits a carefully thought out insulation system is required.

SHORT SUMMARY OF THE PRESENT INVENTION

Accordingly one object of the present invention is to provide a valve component group of the type initially mentioned, in the case of which the main valve has compact dimensions.

A still further aim of the invention is to provide a simple electrical power connection for the pilot valves as a consequence of the compact main valve.

In order to achieve these or other objects appearing from the present specification, claims and drawings, in the present invention there is an intermediate plate, which is placed between the terminal plate and the main valve and has intermediate ducts connecting the terminal and valve ducts, and furthermore at least one pilot valve is arranged on the intermediate plate and controls flow along a pilot duct in the intermediate plate and communicating with the control duct of the main valve, and between the terminal plate and the intermediate plate a disconnectable electrical plug connector is provided on the electrical leads, there being electrical lead sections in the intermediate plate of the respective pilot valve so as to connect the respective pilot valve with the part of the connector placed on the intermediate plate.

Despite the design so as to optimize the supply of power to the pilot valves the invention then makes it possible as well to utilize main valves of conventional design. It is not necessary to cause the electrical signals to pass through the respective main valve, for which reason the main valve may be one with extremely compact dimensions. The pilot valves are then placed in the direct vicinity of the terminal plate since they are mounted remote from the main valve and on the intermediate plate. The latter may be a plain plate with ducts therein, whose intermediate ducts produce a simple fluid connection between the terminal ducts and the valve ducts. Since the intermediate plate is designed without any valve members therein, there is sufficient space available in order to accommodate cable-like electrical lead sections between the connector and the externally mounted pilot valves. This results in an extremely short lead or cable connection with correspondingly low electrical losses. Because the intermediate plate is hardly exposed to any mechanical loads at all, it may more particularly be entirely made of resin material so that the need for insulation does not give rise to any problems. Even if the valve component group is to be fitted with additional valve component group elements located between the terminal plate and the main valve, it is only necessary to have one single connector with male and female parts able to be plugged together, because the position, of the intermediate plate and the pilot valves mounted thereon is not changed in relation to the terminal plate. The pilot signal is able to be supplied without any problems via the pilot duct formed in the intermediate plate, the main valve not itself requiring any pilot valve and being able to be embodied in the form of simple so-called air valve.

Further features and advantages of the invention are defined in the claims.

If the connector has its male and female connector elements respectively on the mutually adjacent sides of the terminal plate and the intermediate plate so that such elements are able to detachably cooperate with each other, the electrical connection will be automatically produced when the intermediate plate is attached.

If a wiring channel is arranged within the intermediate plate the electrical lead sections may be laid without any difficulty. Since the intermediate plate does not have to have any moving parts, there is sufficient space for a suitable duct which for instance may be in the form of a depression in the plate, which is covered over when the main valve or, respectively, another component has been mounted.

A further possible feature of the invention is such that mounting sites are placed laterally on the intermediate plate for the pilot valves present, into which the wiring channel may open via, for instance, a window or the like, this simplifying the placement of the leads.

An intermediate plate fashioned of plastic is particularly simple to manufacture. Owing to its inherently lower strength of the plastic plate it is however an advantage if the main valve or, respectively, another element of the valve component group, coming thereafter is connected with the terminal plate, more particularly by screw means, the intermediate plate being clamped in place therebetween. In this instance there will be no screw thread stresses in the intermediate plate.

Further features and advantages of the invention will be gathered from the ensuing detailed description of an embodiment thereof referring to the drawings.

DETAILED DESCRIPTION OF WORKING EMBODIMENTS OF THE INVENTION

Figure 2:
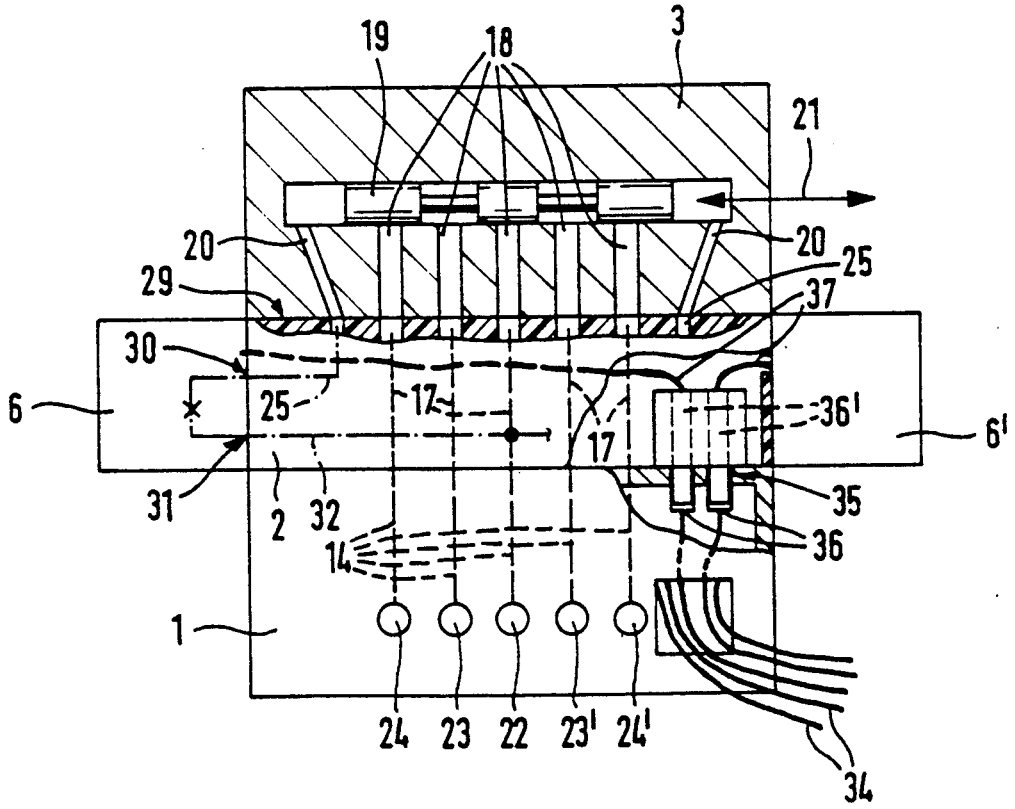
FIG. 2 is a partly broken away side view of the valve component group of FIG. 1 in the assembled state.

The illustrated valve component group possesses a terminal or connecting body termed the terminal plate 1 which in the preferred position of use of the group is lowermost. An intermediate plate 2 is able to be detachably secured to the terminal plate 1. A main valve 3 is able to be fitted on the intermediate plate 2 so that in the preferred embodiment these three groups of components are arranged on top of each other in the vertical direction 10. If required at least one further component element 4 may be arranged between the main valve 3 and the intermediate plate 2, such further element or elements 4 being in the form, for instance, of a so-called regulator plate and/or a choke plate. In FIG. 2 such additional group elements 4 have not been illustrated.

Figure 1:
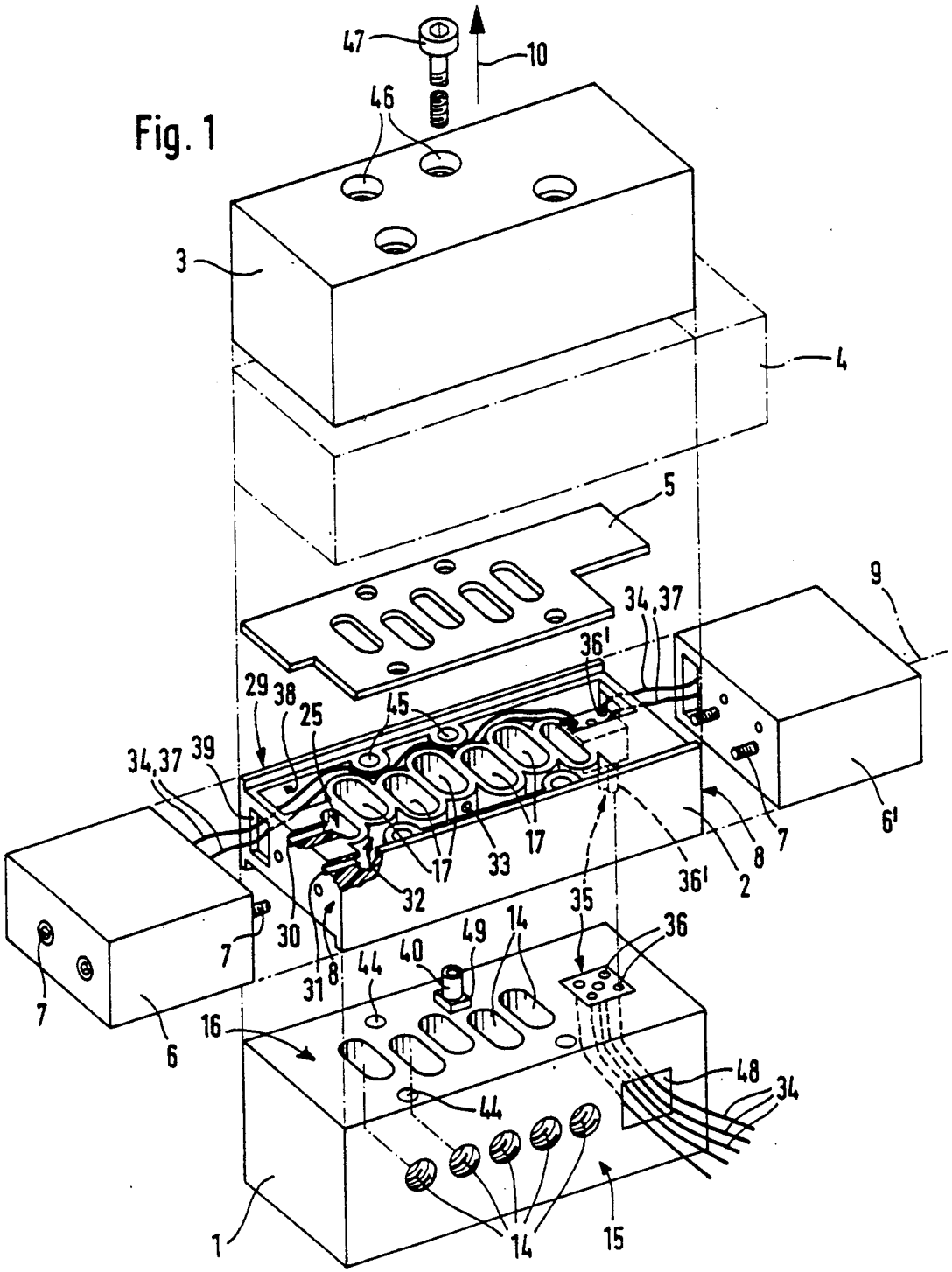
FIG. 1 shows a first working embodiment of the valve component group in accordance with the invention as seen in an exploded and largely diagrammatic view.

Between the individual elements 1 through 4 of the group it is expedient to place gaskets 5, which ensure a fluid-tight connection. To make the drawing more straightforward however, only one such gasket is shown in FIG. 1.

The valve component group shown by way of example furthermore comprises two electrically actuated pilot valves 6 and 6'. They are detachably secured laterally to the intermediate plate 2 for example by screws. As illustrated the intermediate plate 2 has a basic configuration in the form of a parallelepipedon or cube, the two mounting sites 8 being more particularly arranged on opposite end faces of the intermediate plate 2. The longitudinal axis 9 extends through the two pilot valves 6 and 6' and the intermediate plate 2 and is at a right angle to the vertical direction 10.

A plurality of terminal or connection ducts 14 are provided in the terminal plate 1, there being 5 of them in the present case. They respectively open at a terminal side 15, where when required fluid lines such as hose or the like may be connected. At their other ends they open on the component mounting side 16 bearing the intermediate plate 2.

The intermediate plate 2 has a number of intermediate ducts 17, extending through it in the vertical direction 10, the number thereof being equal to the number of terminal ducts 14, with which they are in communication at the component mounting side 16. The intermediate ducts 17 are on the other hand, that is to say at the top, connected with valve ducts 18 of the main valve 3. A valve member 19—often termed a valve plunger—movingly arranged in the main valve 3, is able to connect together or to separate the valve ducts 18 as regards the flow of fluid in accordance with position which it assumes. The main valve 3 is a multi-way valve, as for instance a 5/2 way one, whose design and manner of operation will be basically familiar to the man in the art so that a detailed account thereof is not called for. It only remains to be pointed out that at least one and more particularly two control ducts 20 are provided in the main valve 3, such ducts being able to be vented or put under pressure with operating fluid as may be desired in order to shift the valve member 19 into the one or the other switching setting as is indicated by the arrow 21.

One of the terminal or connection ducts 14 is linked to a feed duct 22 itself able to be connected with a source of fluid under pressure. The two terminal ducts 14 adjacent to each other on the left and right are preferably joined with load ducts 23 and 23' leading to a load. The two terminal ducts 14 shown on the very left are preferably venting ducts 24 and 24' and they may lead out into the surroundings. Dependent on the switching position of the valve member 19 it is thus possible to connect selectively one of the two load ducts 23 and 23' with the feed duct 22, the other load duct then being connected with the adjacent venting duct 24 and 24'. At this juncture it is however to be noted that the invention is not limited to the illustrate design with five ducts.

The fluid control pulse is fed through the control ducts 20 of the two pilot valves 6 and 6'. The same respectively control a pilot duct which is connected with one of the control ducts 20 and formed in the intermediate plate 2 since they control the supply of fluid under pressure as regards the said pilot ducts 25. In the working example the pilot ducts 25 extending in the intermediate plate 2 open at one end at the valve member side 29 of the intermediate plate 2, where they are in communication with the opposite control duct ports, while on the other hand they open at a port 30 at the associated mounting site 8. A branch feed duct 32 also opening at 31 for each mounting site 8 supplies pressurized fluid to the pilot valves 6 and 6' since it is in communication with the middle intermediate duct 17 (at 33) connected with the feed duct 22. The branch duct 32 is best located in the intermediate plate 2 and extends through same in the longitudinal direction 9 in order to then open at the two oppositely placed mounting sites 8. A simple opening 33 in the wall between the branch duct 32 and the respective intermediate duct 17 represents the required fluid connection. Thus the flow of fluid between the branch duct 32 and the pilot valve 25 may be affected by the pilot valves 6 and 6'. A man in the art will be familiar with the internal structure of the pilot valves 6 and 6' so that no explanations thereon or on the manner of operation of the pilot valves will be called for in this respect.

The pilot valves 6 and 6' of the working embodiment each possess a solenoid arrangement, not illustrated, for the operation of their valve member. They receive their electrical power for operation via electrical leads 34, which are more particularly in the form of cables used for electrical leads. A connector 35 is placed on these leads 34 and is mounted in the part between the terminal plate 1 and the intermediate plate 2. The connector has two sets of connector elements 36 and 36' of which one respective set is located on one of the two opposite sides of the plates.

The connector elements 36 arranged on the terminal plate are for instance in the form of female connector elements, which 1 are practically in the form of a group of socket-like units and into which the male connector elements 36' on the intermediate plate with a mating design may be fitted in a detachable manner. It is in this manner that it is possible to produce electrical contact automatically when the intermediate plate 2 is placed on the terminal plate and such contact may be interrupted again when the intermediate plate 2 is removed. There is thus no necessity for the intricate production of a plug and socket connection.

The lead sections connected with the connector elements 36 of the terminal plate 1 lead on the other hand to a control device and/or a power supply which is not illustrated in detail and whence the necessary signals may be passed to the pilot valves 6 and 6'. Within the intermediate plate 2 there furthermore extend further electrical lead sections 37, which on the one hand are connected with the connector elements 36' of the intermediate plate 2 and on the other hand with the pilot valves 6 and 6'. A continuous wiring or lead channel is for this purpose machined in the intermediate plate 2 so as to extend in the direction of the longitudinal axis 9 and having the lead sections 37 laid therein. Because the lead channel 38 opens at both the mounting sites 8—see the window-like ports 39 in FIG. 1—the lead sections 37 may be arranged to extend as far as the pilot valves 6 and 6' without any difficulty. A particularly favorable division of the available space is possible if the lead channel 38 is arranged on that side of the intermediate ducts 17 which is remote from the branch duct 32, said intermediate ducts 17, like the associated ports of the valve ducts 18 and of the terminal ducts 14 preferably being arranged consecutively in a succession along the longitudinal axis 9.

While in the present working embodiment the lead sections 37 are set on the control valve side, it is obviously also possible to provide a detachable connector on the individual lead sections 37 between the pilot valves and intermediate plate.

For facilitating production it is convenient to have the lead channel 38 and/or the branch duct 32 in the form of depressions, which are produced from the side of the terminal plate 1 or of the main valve 3 in the intermediate plate 2. This method has been adopted in the case of the working embodiment shown and the termination of the open duct side is in this case by means of a gasket 5 placed thereon and/or the directly adjoining component group element 3 or, respectively, 4.

In order to ensure freedom from insulation problems it is an advantage if the intermediate plate 2 bearing the pilot valves 6 and 6' is fashioned of plastic. In this case the associated connector elements 36' are preferably of integral construction, i.e. each made in one piece.

The electrical systems of all valves present are now grouped in the plane of the intermediate plate 2. No electrical connections above the level of the intermediate plate 2 are called for. The length of the electrical connections present remains constant, even although the main valve 3 is set at a distance from the terminal plate 1 owing to the intermediate arrangement of a regulator or choke plate. Since for instance regulator plates have control air ducts within them and, because they are used both for simple air valves and also for solenoid valves, it is possible for the connection between the pilot ducts 25 and the control ducts 20 to be produced without any difficulty via the control air ducts. At any event in the additional component group elements no electrical connecting means are called for so that elements of conventional design may be employed. Starting from the intermediate plate 2 bearing the pilot valves it is only necessary for control air to pass towards the main valve for valve operation without any electrical signal. A further advantage is that the main valve 3 may be replaced just as desired by a valve functioning in some other way without any change in the electrical system being called for.

If however for instance a main valve 3 only requiring one pilot valve should be employed, all that is called for is for one of pilot valves 6 and 6' to be replaced by a solid plate (not shown) which dependent on the particular design thereof allows the continuous passage or no passage of the operating fluid.

In order to ensure secure attachment together of the valve component group, more particularly in the case of the use of a plastic intermediate plate, it is an advantage if the intermediate plate 2 is able to be clamped between the terminal plate 1 and the group element arranged on the opposite valve side 29, in this case the main valve 3. In this manner no stresses are then induced by screw threads in the intermediate plate 2. A preferred design on these lines is shown in FIG. 1. In this case stud-like elements 40 are firmly anchored in the mount holes 44 on the component mounting side 16, for example by being screwed thereinto. This leads to secure attachment, because the terminal plate 1 can consist of metal. The upwardly projecting section of the attachment element 40 extends from below into an aligned through opening 45 extending in the vertical direction 10, in the intermediate plate 2. This opening 45 is followed by an aligned attachment opening 46, which extends through the main valve 3 and into which a fastening element 47, in the present case a screwed one, may be introduced. The element 47 may be detachably secured to the attachment element 40 after having being slipped through the attachment hole 46 and the associated opening 45, for example by a screw threaded connection. There is thus a connection with a sort of tie rod, the intermediate plate 2 being clamped securely between the main valve 3 and the terminal plate 1. For the sake of simplicity the drawing only shows one of these attachment means provided.

In order to prevent the attachment element 40 from being turned it has a polygonal section 49 fitting into a polygonal mating recess in the respectively associated opening 45 (not shown).

FIG. 1 furthermore indicates a recess in the terminal plate 1 at 48, through which the leads 34 may be trained from below to the terminal or connection points within the terminal plate.

The embodiments of the invention in which an exclusive property or privilege is claimed are defined as follows.

1. A valve component group comprising:

a terminal plate containing fluid terminal ducts;

a main valve;

a control duct on said main valve, said main valve further having valve ducts communicating with said terminal ducts;

said terminal plate being adapted for connection with the main valve;

a pilot valve having electrical lead sections for its operation and being adapted for cooperation with said main valve and to control flow through said control duct leading to said main valve;

an intermediate plate arranged between said terminal plate and said main valve, said intermediate plate comprising intermediate ducts connecting said terminal ducts and said valve ducts, said intermediate plate also having a pilot duct thereon;

said pilot valve being arranged on said intermediate plate at a mounting site and being arranged to control flow through said pilot duct in said intermediate plate and in communication with said control duct in said main valve; and a disconnectable male-female connector arranged between said terminal plate and said intermediate plate, one connector element of said male-female connector being connected in electrical circuit with said lead sections of said pilot valve to facilitate connection of control circuitry, connected to an other connector element of said male-female connector, to said pilot valve.

2. The valve component group as claimed in claim 1, wherein said connector elements of said disconnectable male-female connector are arranged on mutually adjacent sides of said terminal plate and said intermediate plate, a first connector element provided on said intermediate plate being integral with said intermediate plate.

3. The valve component group as claimed in claim 2, wherein said first connector element and said intermediate plate are integrally molded together.

4. The valve component group as claimed in claim 1, wherein a lead channel is formed within said intermediate plate to accommodate electrical lead sections running between said male-female connector and said mounting site for said pilot valve.

5. The valve component group as claimed in claim 4, wherein said lead channel is in the form of a depression which is covered over by said main valve when said main valve is mounted on said intermediate plate.

6. The valve component group as claimed in claim 4, wherein said lead channel opens at a respective component mounting site associated therewith.

7. The valve component group as claimed in claim 1, wherein said terminal plate and said intermediate plate are stacked on each other vertically, the said pilot valve being located laterally on an end of said intermediate plate.

8. The valve component group as claimed in claim 1, wherein a branch duct is formed in said intermediate plate and is connected at one end with an intermediate duct also in said intermediate plate and thence a supply duct in said terminal plate and at an other end is connected with said pilot valve.

9. The valve component group as claimed in claim 1, wherein said pilot valve is a solenoid valve.

10. The valve component group as claimed in claim 1, wherein said intermediate plate is made of plastic.

11. The valve component group as claimed in claim 1, wherein between said intermediate plate and said main valve a group element comprising at least one of a regulator and a choke plate is arranged and comprises control air ducts communicating at one end with said control duct of said main valve and at an other end with said pilot duct in said intermediate plate.

12. The valve component group as claimed in claim 11, wherein said intermediate plate is clamped between said terminal plate and said group element arranged on a side thereof opposite to said terminal plate and including at least one stud-like fastening element extending into and attached in a recess in said intermediate plate so that said group element and said intermediate plate are connected together by said stud-like fastening element.

13. The valve component group as claimed in claim 11, wherein said intermediate plate and said group element arranged on a side of said main valve have exclusively non-electrical connections.

* * * * *